US010161096B2

(12) United States Patent
Masse et al.

(10) Patent No.: US 10,161,096 B2
(45) Date of Patent: Dec. 25, 2018

(54) GROUND REINFORCING DEVICE

(71) Applicant: SOLETANCHE FREYSSINET, Rueil Malmaison (FR)

(72) Inventors: Frederic Masse, Carnegie, PA (US); Benoit Quandalle, Rueil Malmaison (FR); Brandon Buschmeier, Carnegie, PA (US); Kyle Shatzer, Carnegie, PA (US)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

(21) Appl. No.: 15/168,363

(22) Filed: May 31, 2016

(65) Prior Publication Data

US 2017/0342674 A1 Nov. 30, 2017

(51) Int. Cl.

| | |
|---|---|
| ***E02D 3/12*** | (2006.01) |
| ***E02D 5/24*** | (2006.01) |
| ***E02D 5/80*** | (2006.01) |
| ***E02D 7/22*** | (2006.01) |
| ***E02D 5/56*** | (2006.01) |
| ***E02D 5/60*** | (2006.01) |
| ***E21D 20/02*** | (2006.01) |

(52) U.S. Cl.

CPC ..... *E02D 3/12* (2013.01); *E02D 5/24* (2013.01); *E02D 5/56* (2013.01); *E02D 5/60* (2013.01); *E02D 5/801* (2013.01); *E02D 5/808* (2013.01); *E02D 7/22* (2013.01); *E21D 20/021* (2013.01)

(58) Field of Classification Search

CPC .... E02D 3/12; E02D 5/24; E02D 5/56; E02D 5/60; E02D 5/801; E02D 5/808; E02D 7/22; E21D 20/021

See application file for complete search history.

(56) References Cited

U.S. PATENT DOCUMENTS 683,275 A * 9/1901 Hartung ..... E21B 10/44 175/388
3,087,308 A * 4/1963 Hart ..... E02D 5/54 405/240
4,007,568 A * 2/1977 Soble ..... E02D 27/00 52/126.1

(Continued)

FOREIGN PATENT DOCUMENTS

EP 1471186 A1 * 10/2004 ..... E02D 5/34

*Primary Examiner* — Benjamin F Fiorello

(74) *Attorney, Agent, or Firm* — MH2 Technology Law Group, LLP

(57) ABSTRACT

The disclosure relates to a device for reinforcing a ground on which is disposed a loading structure. Threaded inclusions are disposed vertically within the ground and reinforce said ground. The core diameter of threaded inclusions is between 250 mm and 450 mm and the external diameter is between 350 mm and 600 mm. A load transmitting layer is interposed between the ground and the loading structure disposed thereon, so as to transmit and distribute the load from the loading structure to both the ground and the plurality of inclusions. A ratio between a distance between axes of two adjacent inclusions and the internal diameter of said adjacent inclusions is between 4 and 14, and the inclusions are made from a material having a specified 28-day compressive strength between 5 MPa and 35 MPa.

12 Claims, 5 Drawing Sheets

(56) References Cited

U.S. PATENT DOCUMENTS

| | | | | | |
|---|---|---|---|---|---|
| 4,911,581 | A * | 3/1990 | Mauch | E02D 5/56 | 173/11 |
| 6,079,907 | A * | 6/2000 | Valero Ruiz | E02D 29/0233 | 405/258.1 |
| 6,161,352 | A * | 12/2000 | Frohlich | E04B 5/43 | 52/334 |
| 6,256,954 | B1 * | 7/2001 | Thooft | E02D 27/12 | 405/229 |
| 6,264,403 | B1 * | 7/2001 | Hall | E02D 5/54 | 405/231 |
| 6,672,015 | B2 | 1/2004 | Cognon | | |
| 7,591,329 | B2 * | 9/2009 | Perpezat | E02D 5/385 | 175/263 |
| 8,926,228 | B2 * | 1/2015 | Stroyer | E02D 5/36 | 175/323 |
| 9,328,474 | B2 * | 5/2016 | Arya | E02D 5/18 | |
| 2008/0260470 | A1 * | 10/2008 | Bullivant | E02D 5/46 | 405/232 |

* cited by examiner

| | Classical inclusions | | | Threaded inclusions | | | |
|---|---|---|---|---|---|---|---|
| | DT-1 | DT-2 | DT-3 | TT-1 | TT-2 | TT-3 | TT-4 |
| *Auger configuration* | *400mm Displacement* | *400mm Displacement* | *400mm Displacement* | *280mm core 1x100mm axial wide tooth = 80mm thread 38cm pitch* | *280mm core 1x100mm axial wide tooth = 80mm thread 38cm pitch* | *280mm core 1x100mm axial wide tooth = 80mm thread 38cm pitch* | *280mm core 2x100mm axial wide tooth = 80mm thread 38cm pitch* |
| *Depth(metres)* | *4* | *5.5* | *10.7* | *4* | *5.5* | *10.7* | *5.5* |
| *Ultimate Failure Load (kN)* | *410* | *636* | *>1334* | *471* | *672* | *>1334* | *618* |
| *Tip Load at Ultimate Failure or 300% (kN)* | *156* | *271* | *489* | *120* | *298* | *520* | *196* |
| *Average Skin Friction Engaged (kN/m)* | *64* | *66* | *79* | *88* | *68* | *76* | *77* |

FIG.6

| *Square Spacing (cm)* | *Traditional CMC Heave - Measured (cm)* | *Traditional CMC Heave - Predicted w/ 37% displacement ratio (cm)* | *Threaded CMC Heave - Predicted w/ 37% displacement ratio (cm)* |
|---|---|---|---|
| 152 | 38 | 37 | 23 |
| 168 | | 30 | 19 |
| 183 | 24 | 26 | 16 |
| 198 | | 22 | 14 |
| 213 | | 19 | 12 |
| 229 | | 16 | 10 |
| 244 | | 14 | 9 |

GROUND REINFORCING DEVICE

FIELD OF THE DISCLOSURE

The disclosure relates to improvements of a ground, notably but not exclusively a clay soil.

BACKGROUND OF THE DISCLOSURE

Various types of foundations are already known for erecting loading structures such as buildings or embankments for a highway. It is especially known to dispose piles in the ground above which the building is erected. Traditionally, a network of beams made of traditional reinforced concrete is then disposed at the top of the piles to support the floor of the loading structure, or the floor of such structure to which the piles are connected is designed as a slab able to sustain the local stresses generated by the supporting piles. If the piles are disposed in a mechanically weak ground, the load induced by the building is essentially transmitted by the piles to a harder deeper layer of the ground. Thus, substantially no charge of the building is transmitted to the weak ground and the piles must be designed to support 100% of the load of the building, leading to larger pile diameters and higher ratio of steel reinforcement in the piles. In addition, this generates high stresses and bending moments in the beams or slab above, requiring them to have a greater thickness.

To avoid these issues, it is also known to use rigid or semi-rigid inclusions, called "Controlled Modulus Columns" (CMCs). These inclusions have been used for decades to improve soils and control settlement of structures and embankments. CMCs are semi-rigid, cylindrical concrete columns typically installed in the soil with a hollow-stem lateral-displacement auger.

A plurality of such inclusions is generally disposed in the ground. A load transmitting layer is interposed between the ground and the load structure disposed thereon. As a result, only between 50% and 80% of the load of the supported structure is transmitted to the inclusions through the load transmitting layer, leading to smaller diameters for the inclusions and reduced stresses in the beams or slab supporting the loading structure.

U.S. Pat. No. 6,672,015 discloses a device for reinforcing a ground on which is disposed a loading structure, comprising a series of structural inclusions installed in the ground with a lateral-displacement auger and configured to mechanically reinforce said ground. The inclusions present a constant-diameter cylindrical shape.

SUMMARY OF THE DISCLOSURE

The inventors have realized that traditional inclusions have the disadvantage of requiring a substantial amount of grout. Moreover, because a significant volume of soil is displaced, inclusions can give rise to ground heave. In scenarios where significant heave occurs, quality concerns arise, such as communication between inclusions during installation and vertical separation of the load transmitting layer and inclusions. In extreme cases, it may also lead to excessive tensile stresses in the inclusions. The specific measures traditionally taken to address these concerns, such as phasing of the installation of the inclusions or reinforcing them with steel, affect productivity and costs.

An object of embodiments of the disclosure is to provide a device for reinforcing a ground on which is disposed a loading structure, which is more environmentally friendly than traditional devices and which reduces the quality risks associated with excessive heave.

According to embodiments of the e, a device is provided for reinforcing a ground on which is disposed a loading structure. The device includes a plurality of inclusions disposed vertically within the ground and configured to mechanically reinforce said ground, each inclusion of the plurality of inclusions having an axis and comprising a cylindrical core surrounded by at least one helical thread extending along the axial length of the cylindrical core, the cylindrical core defining an internal diameter of the inclusion and the helical thread defining an external diameter of the inclusion, wherein the internal diameter is between 250 mm and 450 mm and the external diameter is between 350 mm and 600 mm, a load transmitting layer interposed between the ground and the loading structure disposed thereon, configured to transmit and distribute the load from the loading structure to both the ground and the plurality of inclusions, wherein a ratio between a distance between axes of two adjacent inclusions and the internal diameter of said adjacent inclusions is between 4 and 14, and wherein each of the inclusions is made from a material having a specified 28-day compressive strength between 5 MPa and 35 MPa.

In the following description, expressions "axial" and "radial" are considered in respect to the axis of the inclusion.

The 28-day compressive strength is defined in the Building Code Requirements for Structural Concrete, ACI-318-2008, published by the American Concrete Institute®.

By "specified", it is understood that the 28-day compressive strength is the value indicated and used in the technical specifications and design documents of the inclusions.

Preferentially, the specified 28-day compressive strength is between 12 MPa and 27 MPa.

The long-term Young's modulus used for the design of the inclusions is calculated with the following formula:

$$E(\text{psi})=\tfrac{1}{3}*57000*\text{sqrt}(f'c),$$

where f'c is the compressive strength at 28 days (psi).

According to a further object of the disclosure, the helical thread has a radial height between 30 mm and 100 mm.

According to a further object of the disclosure, the helical thread has an axial thickness between 30 mm and 80 mm. This axial thickness is measured at the junction between the thread and the core. Preferentially, the axial thickness is between 40 mm and 60 mm.

According to a further object of the disclosure, the helical thread has a pitch, and wherein a ratio between said pitch and an axial thickness of the helical thread is between 3 and 7. Preferentially, the ratio is between 4 and 6.

According to a further object of the disclosure, the helical thread has a cross section which is substantially rectangular, said cross section being taken in a longitudinal plane of the inclusion.

According to a further object of the disclosure, said material used for making the inclusions is a mortar or a grout.

According to a further object of the disclosure, the load transmitting layer has a thickness between 0.3 m and 1.5 m, preferentially between 0.3 and 1 m. This thickness is measured between two adjacent inclusions.

According to a further object of the disclosure, at least one of said plurality of inclusions comprises first and second helical threads.

According to a further object of the disclosure, a ratio between: an axial distance between said first and second helical threads; and an axial thickness of the first helical thread, s between 3 and 7. Preferentially, the ratio is between 4 and 6.

BRIEF DESCRIPTION OF THE DRAWINGS

FIG. 6 is a table summarizing the results of test loads carried out in Leland.

DETAILED DESCRIPTION OF THE PREFERRED EMBODIMENT

According to the figures, embodiments of the disclosure include a device 10 for reinforcing a ground on which is disposed a loading structure. In this non-limiting example, the loading structure is a building 12. Without departing from the scope of the disclosure, the loading structure could be an embankment, a road, or any other loading structure.

Figure 1:
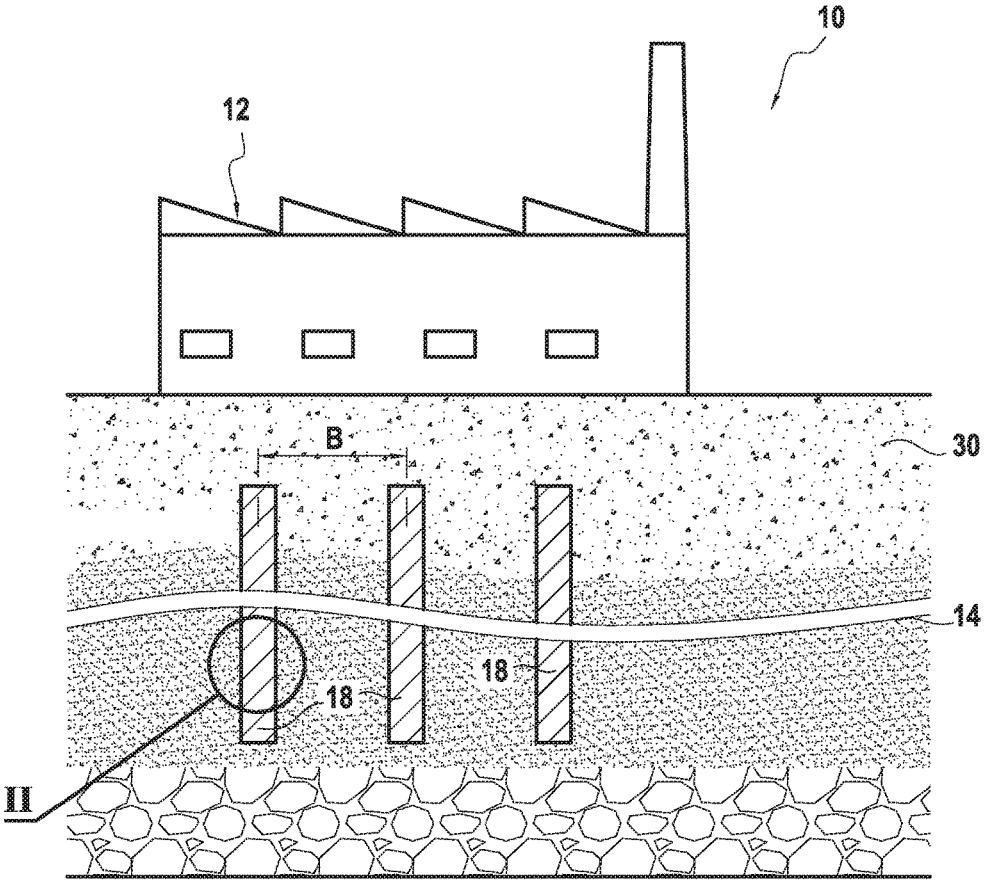
FIG. 1 shows a vertical section of a reinforced ground comprising a device embodying the present disclosure.

In the example of FIG. 1, the ground 14 is a soft ground such as clay located on a lower layer of harder soil.

The device 10 comprises a plurality of inclusions 18 disposed vertically within the ground 14 and configured to mechanically reinforce said ground 14. While only three inclusions are illustrated on FIG. 1, it is understood that the device according to the disclosure can comprise much more inclusions, depending on the ground type or on the loading structure.

In FIG. 1, the inclusions are schematized as being cylindrical. However, as more precisely illustrated in FIG. 2, inclusions according to the disclosure are threaded.

Figure 2:
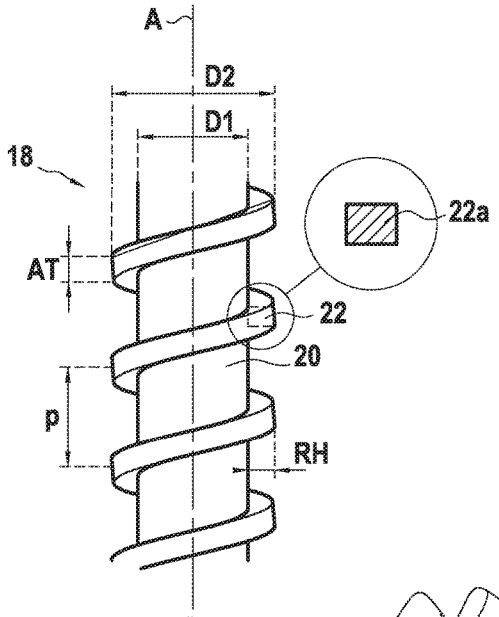
FIG. 2 is a detailed view of an inclusion of the device of FIG. 1.

In FIG. 2, the inclusion 18 has an axis A and comprises a cylindrical core 20 surrounded by a single helical thread 22 extending along the axial length of the cylindrical core. In this example, the helical thread 22 extends along substantially the whole length of the cylindrical core 20.

The cylindrical core defines an internal diameter D1 of the inclusion 18. In this example, the internal diameter D1 is 280 mm.

The helical thread defines an external diameter D2 of the inclusion 18, which in this example is 380 mm.

The helical thread 22 has a pitch p, defined as the axial distance between two successive threads, which is equal to 380 mm in this example.

Moreover, the helical thread has a radial height RH of 80 mm in this example, and an axial thickness AT of 75 mm.

Figure 3A:
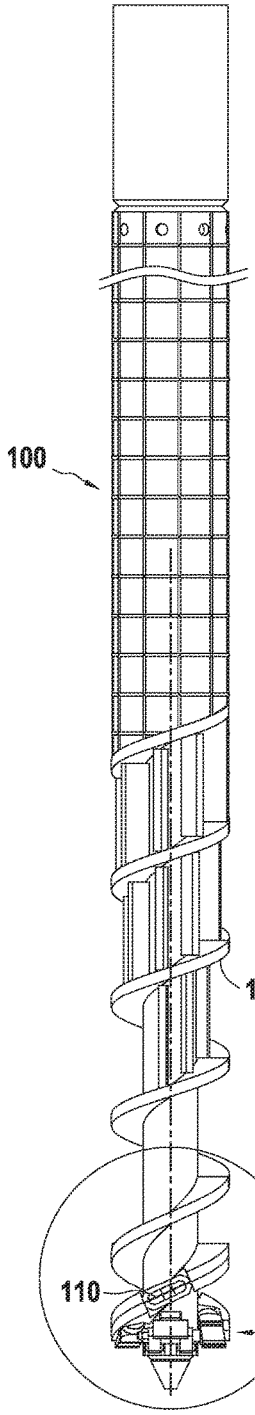
FIGS. 3A, 3B and 3C illustrate an example of an auger having one cutting tooth for making the inclusions of FIG. 1.
Figure 3B:
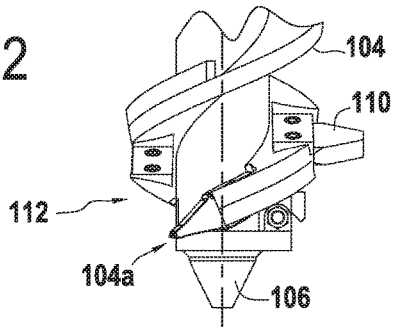
Figure 3C:
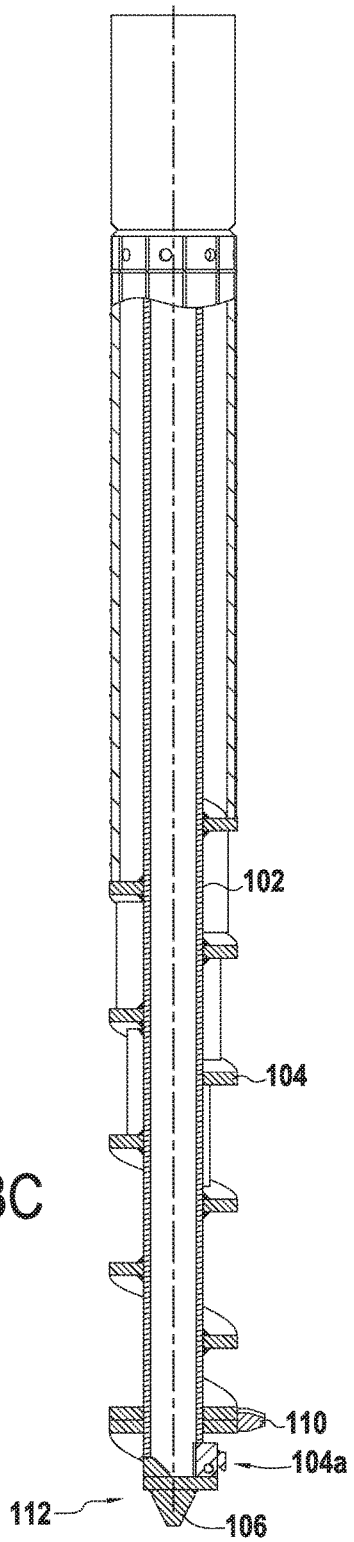

This threaded geometry is achieved by using a displacement auger 100, an example of which being illustrated in FIGS. 3A, 3B and 3C. The displacement auger 100 comprises a hollow cylindrical core 102 surrounded in its bottom part by a helical flight 104. The bottom end 104*a* of the hollow cylindrical core 102 has a hinged cap 106 for closing the hollow cylindrical core 102 during the boring.

The displacement auger 100 is provided with one protruding cutting tooth 110 located near a bottom end 112 of said displacement auger and extending radially from the helical flight 104.

In this example, the radial height of the cutting tooth 110 is about 100 mm.

The displacement auger 100 is screwed into the soil to a predetermined depth, which gives rise to a lateral displacement of the soil. Such displacement increases the density of the surrounding soil, and as such increases its strength and bearing capacity. During insertion of the displacement auger 100, the cutting tooth cut a helical groove in the bore wall, which is immediately filled by the laterally displaced soil. After completion of the bore, the displacement auger is raised, the hinged cap 106 opens, and material is injected through the hollow cylindrical core 102 into the bore. At the same time, as the displacement auger 100 is raised, the same rotational direction is maintained. The cutting tooth 110 cuts a fresh helical groove into the bore wall around the stem. The groove is filled with the injected material at the same time as the central bore so as to make the threaded inclusion.

Figure 4:
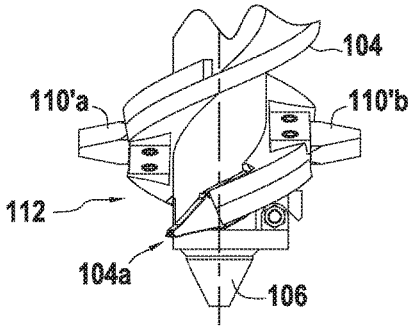
FIG. 4 illustrates a bottom end of another example of an auger having two cutting teeth.
Figure 5:
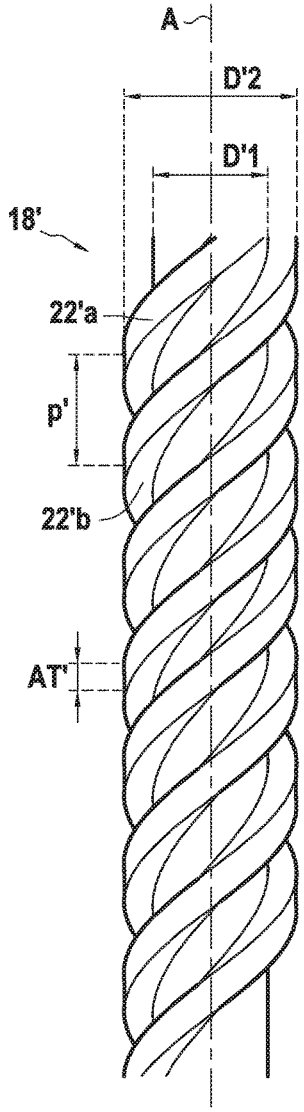
FIG. 5 illustrates a double helix inclusion made with the auger of FIG. 4.

According to another example illustrated in FIG. 4, the displacement auger 100' can also be provided with two protruding cutting teeth 110'*a* and 110'*b*, diametrically opposed, so as to make a double helix inclusion 18' having first and second helical threads 22'*a*,22'*b* as illustrated in FIG. 5. In this case, the pitch p' is defined as the axial distance between first and second helical threads 22'*a*,22'*b*. The pitch p' is about 200 mm, and the axial thickness AT' is about 40 mm, so that the ratio between the pitch p' and the axial thickness is about 5.

The benefit of two cutting teeth is the ability to create a double helix thread shape with the same pitch as with a single tooth. This provides a pull rate that is twice as fast, or the possibility to rotate the auger more slowly while maintaining the same pull rate in order to tackle firmer ground conditions that offer an increased resistance to the rotational movement.

Before or after the installation of inclusions 18, the ground 14 is covered by a load transmitting layer 30, also called "load transfer platform". From FIG. 1, it is understood that the load transmitting layer is interposed between the ground 14 and the loading structure 12 disposed thereon. More precisely, the load transmitting layer is interposed between the upper end of the inclusions 18 and the loading structure 12, so that there is no direct connection between the inclusions 18 and the loading structure 12.

The purpose of the load transmitting layer 30 is to transmit and distribute the load from the loading structure to both the ground and the plurality of inclusions. In this example, the thickness of the load transmitting layer 30 is about 1 m, being measured between two adjacent inclusions.

Depending on the nature and characteristics of the ground to improve, the load transmitting layer transfers between 30% and 90% of the load of the supported structure to the inclusions, and typically between 40% and 70%.

After settlement, the upper ends of the inclusions 18 generally penetrate into the load transmitting layer 30, as illustrated in FIG. 1.

In example of FIG. 1, a ratio between a distance B between axes A of two adjacent inclusions and the internal diameter of said adjacent inclusions is about 5, and each of the plurality of inclusions is made from a mortar and has an instantaneous Young's modulus of about 20,000 MPa.

Comparative Load Tests

Load tests have been carried out in Leland, N.C., USA in August 2015.

Table of FIG. 6 provides a brief summary of the seven load tests performed. DT-1 to DT-3 are classical inclusions, while TT-1 to TT-4 are threaded inclusions according to the disclosure.

Inclusions DT-1 and TT-1 were each installed at 4 meters depth without tipping into a bearing layer of any kind. Thus, they were expected to plunge at relatively light loads, with relatively low load realized at the tip of the inclusions during plunging failure. The results of these two load tests validate that inclusions DT-1 and TT-1 having similar deflecting plots, with load tests DT-1 realizing about 156 kN at the tip at failure, and TT-1 realizing an about 120 kN at failure.

By dividing the remaining load capacity (i.e. difference between Ultimate Failure Load and Tip Load at Ultimate Failure) by the installed length, the skin-friction capacity per meter can be approximated. In this case, the skin friction capacity of DT-1 is about 64 kN/m, while the skin friction capacity of TT-1 is about 88 kN/m. As a result, threaded TT-1 skin-friction resistance appears to be greater than that of the comparable classical DT-1.

Making of inclusion DT-1 required about 0.51 $m^3$, while the making of inclusion TT-1 required about 0.311 $m^3$, which is 39% less in volume than for making DT-1.

Classical inclusion DT-2 and threaded inclusions TT-2, TT-4 were all installed 5.5 m deep, into a medium-dense bearing layer. The two threaded inclusions TT-2,TT-4, performed almost identically, as mentioned in the table of FIG. 6, indicating that a "double helix" cutting tooth configuration is a valuable alternative to a single-tooth configuration, considering the increased pull-rate it allows. The nearby displacement load test with inclusion DT-2 deflected a little less severely than TT-2 and TT-4, but all three inclusions appeared to fail in plunging at nearly the same load (approximately 620 kN). Applying similar logic for calculation skin-friction capacities shows that all three inclusions DT-2, TT-2 and TT-4 have similar capacity.

Making of inclusion DT-2 required about 0.708 $m^3$ of material, while the making of inclusions TT-2 and TT-4 required about 0.425 $m^3$ of material, which is 40% less in volume than for making DT-2.

Classical inclusion DT-3 and threaded inclusion TT-3 were each installed to a depth of 11 m, into a very dense bearing layer. The maximum capacity of the load test setup was reached in both cases without structural and geotechnical failure.

Making of inclusion DT-3 required about 1.39 $m^3$ of material, while the making of inclusion TT-3 required about 0.85 $m^3$, which is 39% less in volume than for making DT-3.

These results show that threaded inclusions with a 280-mm internal diameter, 380-mm pitch, 100-mm cutting tooth, and 380 mm external diameter performed similarly to traditional 400-mm diameter inclusions. Moreover, in most cases, skin-friction capacity of the threaded inclusions was slightly better than the classical inclusions. The performance of threaded inclusions is also expected to improve further with a reduced pitch dimension compared to the pitch dimension tested. In average, the material volume needed to make threaded inclusions was 39.2% in volume less than for classical inclusions.

Consequently, load tests performed in Leland show that threaded inclusions according to the disclosure have similar properties as traditional ones while requiring smaller quantities of material. Thus, the device according to embodiments of the disclosure has less impact on the environment and is less costly than traditional soil reinforcing devices.

Also, a network of threaded inclusions was built in Leland (Trial Threaded CMCs). 22 threaded inclusions have been installed along three rows. Adjacent inclusions are spaced at 2.4 m intervals.

In these examples, the material used to make the inclusions is a mortar having a specified 28-day compressive strength of about 27.7 MPa. This value is the one used to design the inclusions.

The long-term Young Modulus of the inclusions is (in psi) ⅓*57000*sqrt(f'c), where f'c is the compressive strength at 28 days (psi). A grout could be used instead of mortar.

Comparative Heave Calculations

The inventors have also run heave calculations, using three different methods, which show a significant heave reduction when using threaded inclusions:

Method #1: this method is derived from the paper "Ground heave around driven piles in clay"—by Sew Gue (1984);

Method #2: in this method, the volume of heave is approximated as a fixed percentage of the volume of laterally displaced soil over the full length of the inclusion;

Method #3: in this method, the volume of heave is approximated as the volume displacement over a length equal to 30 times the inclusion diameter (the depth of influence).

According to the inventors, the "worst-case" scenario for heave is using a 450-mm inclusion on 1.5 meter spacing square grid with a depth of clay penetration of 15 m. The effective volume displaced to produce a 450-mm equivalent threaded inclusion is about equal to a 360-mm diameter traditional inclusion. Comparing heaves with the above three methods yields the following:

A. Heave Calculation with 450-mm Traditional Inclusion:

| Method #1 (Empirical method) | |
|---|---|
| Max depth of influence | 674 cm |
| Heave | 31 cm |

| Method #2 (Replacement ratio method) | |
|---|---|
| Heave to displ. Ratio | 40% |
| Heave | 42 cm |

| Method #3 (Influence depth method) | |
|---|---|
| Max depth of influence | 674 cm |
| Heave | 46 cm |

B. Heave Calculation with 360-mm Traditional Inclusion (Equivalent to a 330-mm Core Diameter Threaded Inclusion):

| Method #1 (Empirical method) | |
|---|---|
| Max depth of influence | 546 cm |
| Heave | 20 cm |

| Method #2 (Replacement ratio method) | |
|---|---|
| Heave to displ. Ratio | 40% |
| Heave | 27 cm |

| Method #3 (Influence depth method) | |
|---|---|
| Max depth of influence | 546 cm |
| Heave | 24 cm |

Consequently, replacing a 450-mm traditional inclusion by a 330-mm internal diameter threaded inclusion (having the same volume as the 360-mm traditional inclusion) results in a 35 to 47 percent reduction in heave.

Figures 7A, 7B:
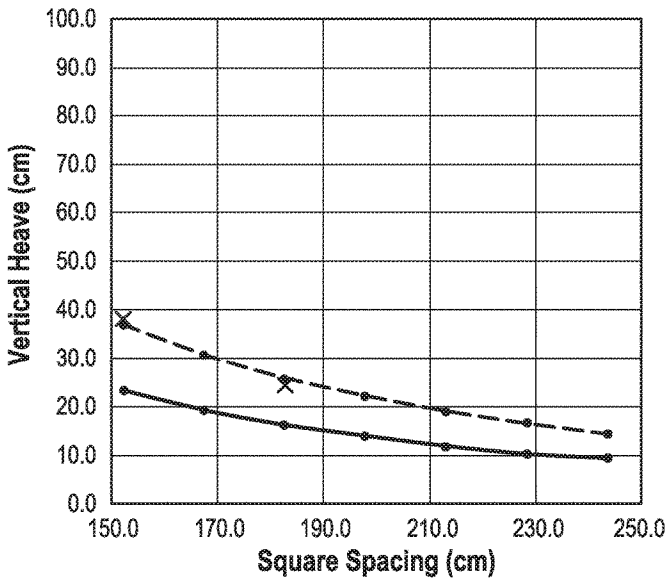
FIG. 7A and FIG. 7B are a table and a graph summarizing heave prediction calculations for threaded inclusions.

Another simulation was carried out, based on a real project performed in Bellmawr, N.J., USA. The results are indicated in the table of FIG. 7A and in the graph of FIG. 7B.

Two rough data points were used to estimate a "displacement ratio" (as used in Method #2 described previously) for this project conditions. According to the inventors, such method is one of the best ways to demonstrate the effects on heave of substituting traditional inclusions with threaded inclusions according to the present disclosure because the replacement ratio and the calculation method are checked against actual heave measurements.

The two data points are:

14.6-m clay penetration, 450-mm diameter—traditional inclusion—1.5-m square spacing, 38-cm average observed heave;

14.6-m clay penetration, 450-mm diameter—traditional inclusion—1.8-m square spacing, 24-cm average observed heave;

The displacement ratio estimated with these two data points is about 37%. This means that, for a given volume displaced in a unit cell equal to one spacing squared (2.3 square meters), 37% displaced volume can be expected to translate into vertical heave.

Then, predicted heave values were estimated using method #2 with a ratio of 37%, at square spacing ranging from 1.5 m to 2.4 m. Traditional inclusions were compared to threaded inclusions according to the disclosure of the same equivalent outer diameter. To achieve a 450 mm outer diameter inclusion, a 330 mm core auger would be needed for the optimal threading tooth configuration. Moreover, the equivalent volume of a 330 mm core threaded inclusion is about equal to a 360 mm traditional inclusion (which is what was used to estimate heave).

This method shows that heave is much lower when using threaded inclusions according to the disclosure.

As a result, another advantage of embodiments of the disclosure is to substantially reduce the platform heave, which decreases the quality risk associated with excessive heave.

As previously mentioned, the inclusions are preferentially from mortar. For instance, for a specified compressive strength (at 28 days) of 21 MPa, the following mortar composition can be used:

About 270 kg of cement;

Fly ash or slag;

Sand or stones (max 10 mm size);

Approximately 170 L water;

Additives such as super plasticizer, water reducer, etc. . . . Alternatively, the inclusions could be made from concrete.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Where any standards of national, international, or other standards bodies are referenced (e.g., ISO, ACI, etc.), such references are intended to refer to the standard as defined by the standards body as of the priority date of the present specification. Any subsequent substantive changes to such standards are not intended to modify the scope and/or definitions of the present disclosure and/or claims.

It is intended that the specification and examples be considered as exemplary only, with a true scope of the disclosure being indicated by the following claims.

What is claimed is:

1. A device for reinforcing a ground on which is disposed a loading structure, said device comprising:

a plurality of inclusions disposed vertically within the ground and configured to mechanically reinforce said ground, the inclusions being formed in situ, each inclusion of the plurality of inclusions having an axis and comprising a cylindrical core surrounded by at least one helical thread extending along the axial length of the cylindrical core, the cylindrical core defining an internal diameter of the inclusion and the helical thread defining an external diameter of the inclusion, wherein the internal diameter is between 250 mm and 450 mm and the external diameter is between 350 mm and 600 mm, wherein the helical thread has a pitch, and wherein a ratio between said pitch and an axial thickness of the helical thread is between 4 and 6, a load transmitting layer interposed between the ground and the loading structure disposed thereon, configured to transmit and distribute the load from the loading structure to both the ground and the plurality of inclusions, wherein a ratio between a distance between axes of two adjacent inclusions and the internal diameter of said adjacent inclusions is between 4 and 14, and wherein each of the inclusions comprises a mortar having a specified 28-day compressive strength between 12 MPa and 27 MPa.

2. The device according to claim 1, wherein the helical thread has a radial height between 30 mm and 100 mm.

3. The device according to claim 1, wherein the helical thread has an axial thickness between 30 mm and 80 mm.

4. The device according to claim 1, wherein the load transmitting layer has a thickness between 0.3 m and 1.5 m.

5. The device according to claim 1, wherein at least one of said plurality of inclusions comprises first and second helical threads.

6. The device according to claim 5, wherein a ratio between an axial distance between said first and second helical threads and an axial thickness of the first helical thread, is between 3 and 7.

7. A device for reinforcing a ground on which is disposed a loading structure, said device comprising:

a plurality of in situ formed inclusions disposed vertically within the ground and configured to mechanically reinforce said ground, each inclusion of the plurality of inclusions having an axis and comprising a cylindrical core surrounded by at least one helical thread extending along the axial length of the cylindrical core, the cylindrical core defining an internal diameter of the inclusion and the helical thread defining an external diameter of the inclusion, wherein the internal diameter is between 250 mm and 450 mm and the external diameter is between 350 mm and 600 mm, and at least one of said plurality of inclusions comprises first and second helical threads, the first helical thread having a pitch, the second helical thread being translated axially by a distance less than said pitch relative to the first helical thread, a load transmitting layer interposed between the ground and the loading structure disposed thereon, configured to transmit and distribute the load from the loading structure to both the ground and the plurality of inclusions, wherein a ratio between a distance between axes of two adjacent inclusions and the internal diameter of said adjacent inclusions is between 4 and 14, and wherein each of the inclusions comprises a material having a specified 28-day compressive strength between 5 MPa and 35 MPa.

8. The device according to claim 7, wherein the first helical thread has an axial thickness between 30 mm and 80 mm.

9. The device according to claim 7, wherein the first helical thread has a pitch, and wherein a ratio between said pitch and an axial thickness of the first helical thread is between 3 and 7.

10. The device according to claim 7, wherein said material is mortar or grout.

11. The device according to claim 7, wherein the load transmitting layer has a thickness between 0.3 m and 1.5 m.

12. The device according to claim 7, wherein a ratio between an axial distance between said first and second helical threads and an axial thickness of the first helical thread, is between 3 and 7.

* * * * *